US005806437A

United States Patent [19]

Huang

[11] Patent Number: 5,806,437

[45] Date of Patent: Sep. 15, 1998

[54] TABLE WITH MULTIPLE FOLDING SEGMENTS

[75] Inventor: Chun Te Huang, Taipei, Taiwan

[73] Assignee: Latitude Tree Furniture Sdn. Bhd., Malaysia

[21] Appl. No.: 854,498

[22] Filed: May 12, 1997

[51] Int. Cl.[6] ..... A47B 1/00

[52] U.S. Cl. ..... 108/86; 108/87

[58] Field of Search ..... 108/86, 87, 83, 108/84, 89

[56] References Cited

U.S. PATENT DOCUMENTS

| | | | |
|---|---|---|---|
| 3,336,883 | 8/1967 | Wengi | 108/86 |
| 4,553,485 | 11/1985 | Lee | 108/86 |
| 4,794,869 | 1/1989 | Chiu | 108/86 |
| 5,577,450 | 11/1996 | Huang | 108/86 |

FOREIGN PATENT DOCUMENTS

| | | | |
|---|---|---|---|
| 1012786 | 12/1965 | United Kingdom | 108/86 |

*Primary Examiner*—Peter M. Cuomo
*Assistant Examiner*—Gerald A. Anderson
*Attorney, Agent, or Firm*—Raymond Sun

[57] ABSTRACT

A table has first and second extendable bar structures positioned parallel to each other. A first table end segment is secured to the first outer ends of the extendable bar structures, and a second table end segment is secured to the second outer ends of the extendable bar structures. First and second crossing bars are connected to and extend between the first and second extendable bar structures. A rod is connected between the first and second crossing bars, and a plurality of removable table segments are positioned between the first and second table end segments. Each removable table segment is rotatably coupled to the rod to facilitate storage of each removable table segment under the first and second table end segments.

20 Claims, 5 Drawing Sheets

TABLE WITH MULTIPLE FOLDING SEGMENTS

BACKGROUND OF THE INVENTION

1. Field of the Invention

The present invention relates to tables, and in particular, to a table having a plurality of foldable segments that can be folded and stored underneath a table top when it is desired to decrease the overall size of the table top.

3. Description of the Prior Art

It is well-known to provide tables with center segments that can be removed when it is desired to decrease the overall size of the table top. A common example is the dining table, which is usually made of wood and has one or two legs supporting the table top. The center part of these dining tables is provided with one or more removable segments sandwiched between two end segments. To decrease the overall size of the table top, the two end segments are pulled apart and the removable segment(s) removed. The end segments that form the table top are then pushed back together with a resulting smaller table top. When it is desired to increase the size of the table top, the two end segments are pulled apart again, the removable segment(s) placed between the end segments, and the end segments pushed back together to provide a larger table top.

These prior art tables suffer from the drawback that the user often needs to find a place to store the removed segments. The heavy weight of these wooden segments also makes it inconvenient to move these segments around the house while the user is in search for a temporary storage location. This inconvenience is greater where homes are small and storage space scarce.

In response to these problems, attempts have been made to fold and store these removable segments below the table top, and in particular, below the two end segments that form the table top. However, most of these attempts have only provided tables with only one removable segment that can be nested or stored under the table top. Unfortunately, providing only one removable segment for a table reduces the user's options. For example, the user can only select between two table top sizes (the full size and the reduced size with the removable segment stored below), while a table top having two or three removable segments allows the user the option of selecting between three or more table top sizes.

Thus, there is still a need for a table which provides for self-storage of two or more removable segments below the table top, which is stable in the reduced-size configuration, and which is easy to install and use.

SUMMARY OF THE DISCLOSURE

In order to accomplish the objects of the present invention, there is provided a table having first and second extendable bar structures positioned parallel to each other. A first table end segment is secured to the first outer ends of the extendable bar structures, and a second table end segment is secured to the second outer ends of the extendable bar structures. First and second crossing bars are connected to and extend between the first and second extendable bar structures. A rod is connected between the first and second crossing bars, and a plurality of removable table segments are positioned between the first and second table end segments, with each removable table segment rotatably coupled to the rod to facilitate storage of each removable table segment under the first and second table end segments. A support bar is connected between the first and second crossing bars and spaced apart from the rod.

In the table according to the present invention, each removable table segment includes first and second leaves hingedly connected to each other, with the rod rotatably coupled to the bottom surface of the first leaf. In a preferred embodiment according to the present invention, a block is attached to the bottom surface of the first leaf and has a through-bore for rotatably receiving the rod.

In one embodiment of the present invention, the second leaf has a bottom surface which rests on the support bar, and the first leaf rests on the second leaf and is rotatably supported under the rod, when each removable table segment is stored under the table end segments. The first leaf has a side wall that can be folded towards the bottom surface of the first leaf and retained against the bottom surface by a catch arrangement when the removable table segment is stored under the first and second table end segments.

In another embodiment of the present invention, each extendable bar structure includes a fixed bar having opposing sides, and first and second slidable bars that are slidably coupled to each of the opposing sides of the fixed bar to facilitate relative movement between each slidable bar and the fixed bar. Each extendable bar structure further includes a ratchet wheel, and each slidable bar includes teeth for engaging the ratchet wheel. The first table end segment is secured to the first slidable bars of the first and second extendable bar structures, and the second table end segment is secured to the second slidable bars of the first and second extendable bar structures. The first and second crossing bars are connected to and extend between the fixed bars of the first and second extendable bar structures.

Thus, the table according to the present invention allows for the provision of two or more removable segments that can be folded and stored underneath the table top. The removable segments are stored in a manner which provides stable support for the stored segments. The operations required to store one or more of these removable segments, and to re-install them to achieve the maximize table top size, are simple and can be carried out quickly.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

A first embodiment of the present invention is illustrated in FIGS. 1–5. The table 10 has two removable center segments 12 and 14 disposed between two end segments 16 and 18. The four segments 12, 14, 16 and 18 are supported by an expandable support frame.

Figure 1:
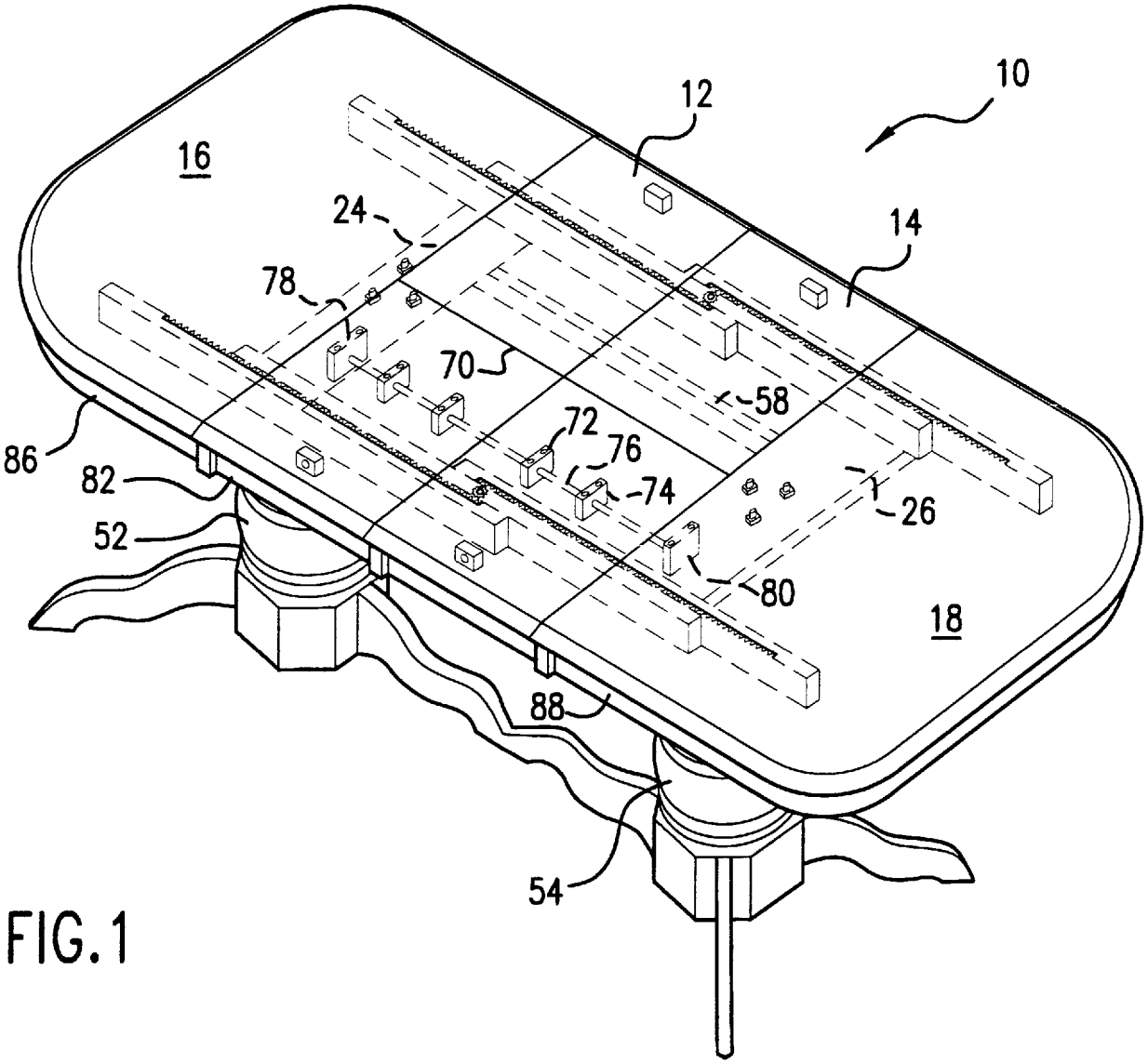
FIG. 1 is a perspective view of a table according to the present invention.
Figure 4:
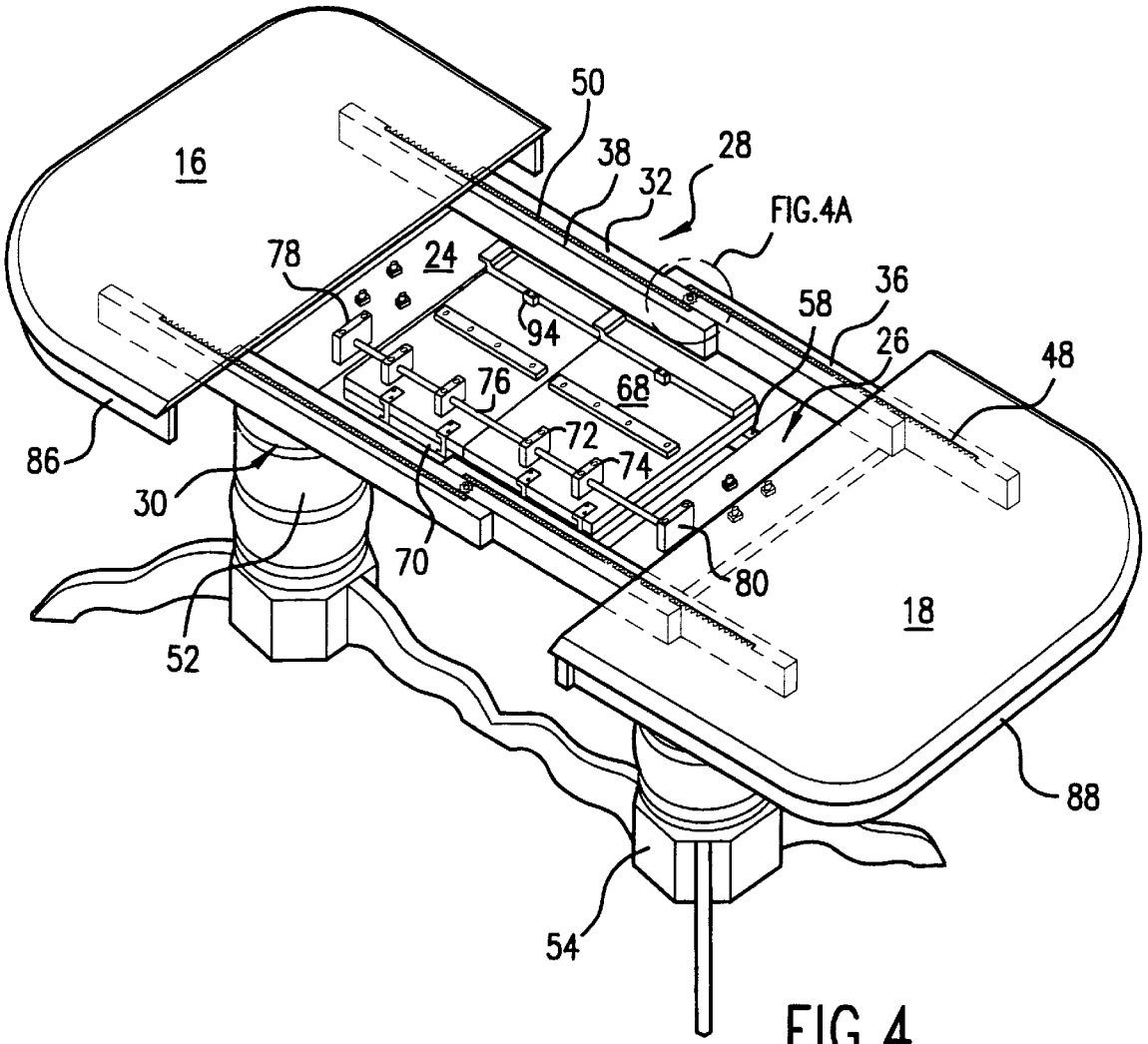
FIG. 4 is a perspective view of the table of FIG. 1 illustrating two folded removable segments in their storage position.
Figure 4A:
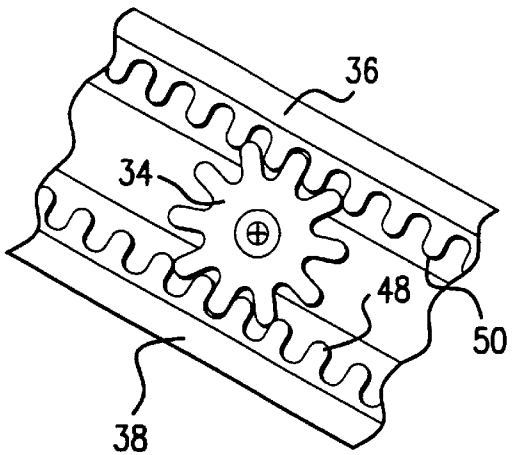
FIG. 4A is a sectional view taken from the region designated 41—4 in FIG. 4.
Figure 5:
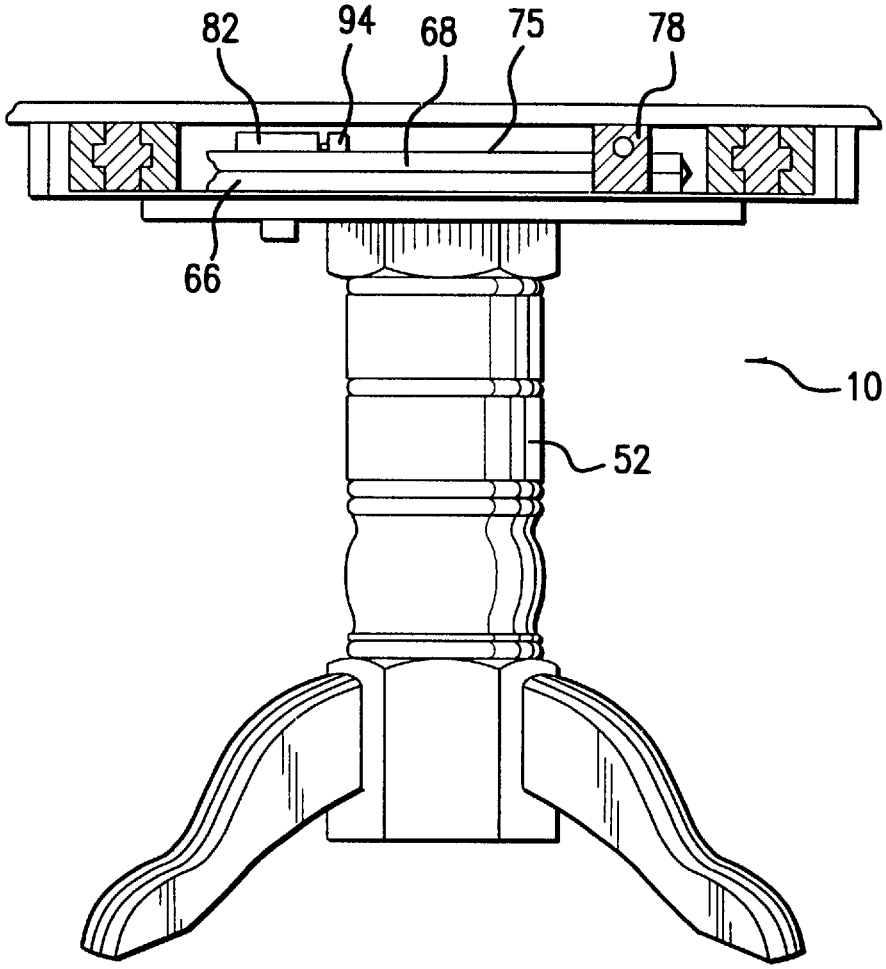
FIG. 5 is a cross-sectional side view of the table of FIG. 1 after the two removable segments have been stored.

Referring more particularly to FIGS. 1, 4 and 4A, the expandable support frame includes two generally parallel crossing bars 24 and 26 extending between a first extendable support bar structure 28 and a second extendable support bar structure 30 that extend longitudinally and generally parallel to each other. The first extendable support bar structure 28 includes a fixed bar 32 having a ratchet wheel 34 provided at approximately its center, and two slidable bars 36 and 38 on opposite sides of the fixed bar 32. The fixed bar 32 is provided with mechanisms for slidably supporting the slidable bars 36, 38. As a non-limiting example, the side of each slidable bar 36 and 38 facing the fixed bar 32 may be provided with a mating protrusion that is adapted to fit inside and slide along a groove provided along each side of the fixed bar 32. As another non-limiting example, each slidable bar 36 and 38 may be provided with a groove that is adapted to receive protrusions provided along each side of the fixed bar 32. Other conventional slidably supporting mechanisms can be provided without departing from the spirit and scope of the present invention. A row of teeth 48, 50 are provided on the upper surface of each slidable bar 36, 38, respectively, for engaging the teeth of the ratchet wheel 34.

Thus, the slidable bars 36 and 38 can be slid along the opposing sides of the fixed bar 32 in opposite directions to adjust the length of the first extendable bar structure 28, with the ratchet wheel 34 operating to ensure consistent extension of the slidable bars 36, 38 in both directions, and to limit or prevent relative movement between the slidable bars 36, 38 and the fixed bar 32 when the table 10 is in use. The structure of the second extendable bar structure 30 is the same as the first extendable bar structure 28, and shall not be described further herein.

The crossing bars 24 and 26 are attached to the bottom surfaces of the fixed bars 32 of the first and second extendable bar structures 28, 30, and therefore extend across the width defined by the fixed bars 32. Legs 52 and 54 are connected to the center of the crossing bars 24 and 26, respectively, to support the table 10. A support bar 58, shown in FIG. 3 and in phantom in FIG. 1, extends between and is connected to the two crossing bars 24 and 26 at a position offset from the center of the crossing bars 24 and 26 closer to the first extendable bar structure 28.

End segment 16 is connected and supported at the outer end of both slidable bars 38, and end segment 18 is connected and supported at the outer end of both slidable bars 36. Thus, end segments 16 and 18 may be slidably moved towards or away from each other by the relative sliding movement between the slidable bars 36, 38 and the fixed bars 32.

Removable segments 12 and 14 are preferably identical in configuration, so only one removable segment 14 will be further described herein. Those skilled in the art will appreciate that more than two removable segments 12, 14 can be provided between the end segments 16 and 18.

Figure 2:
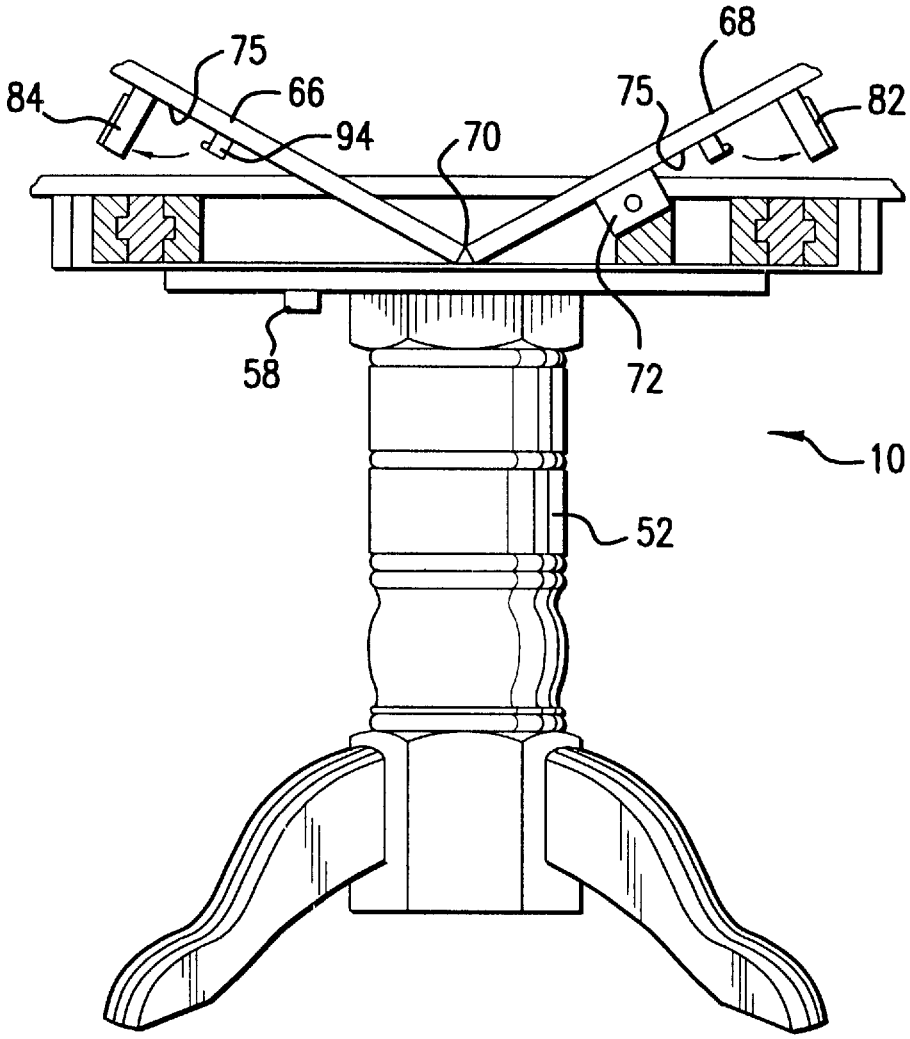
FIG. 2 is a side plan view of the table of FIG. 1 illustrating the folding of a leaf of one removable segment.
Figure 3:
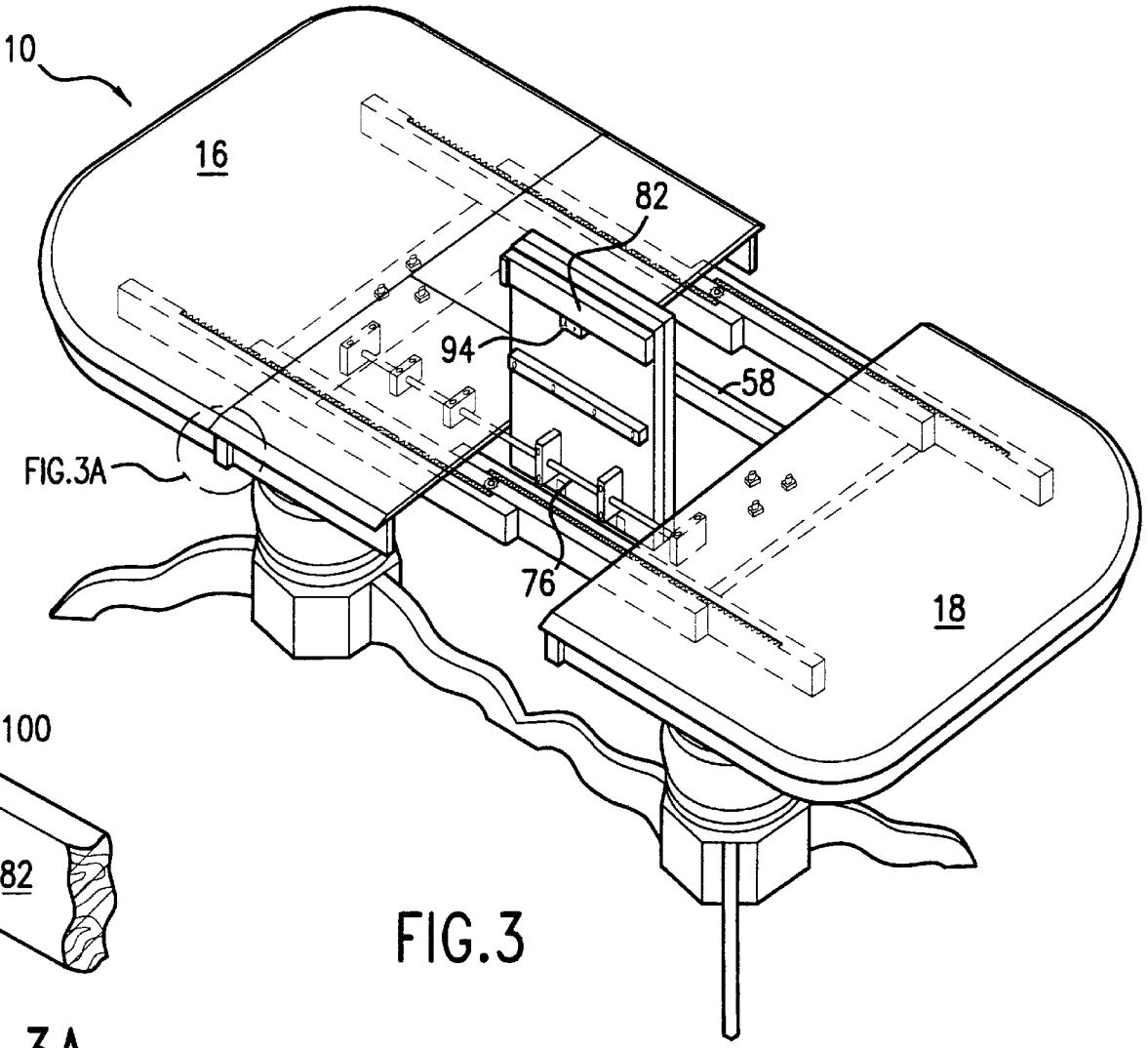
FIG. 3 is a perspective view of the table of FIG. 1 illustrating the folding of a leaf of one removable segment.
Figure 3A:
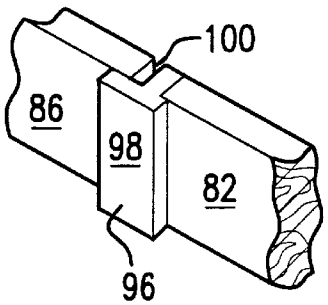
FIG. 3A is a sectional view taken from the region designated 3—3 in FIG. 3.

Removable segment 14 has two leaves 66 and 68 that can be folded about a plurality of hinge connections 70 located at the center of the removable segment 14 (see FIGS. 2 and 4). Each leaf 66 and 68 has a side wall 84 and 82, respectively. The side walls 82 and 84 are aligned with the side walls, such as 86 and 88, of the end segments 16 and 18. Each side wall 82 and 84 is provided with a hinge mechanism so that it may be folded towards the bottom surface 75 of the respective leaf 68 and 66, respectively. A catch arrangement 94, such as but not limited to a hook or a latch mechanism, may be provided at the bottom surface 75 to hold each side wall 82 or 84 when the side wall is in its folded position. As described in further detail below, folding the side walls 82 and 84 reduces the profile of the leaves 66 and 68 to facilitate storage of the removable segments 12, 14 under the end segments 16, 18. Referring to FIGS. 3 and 3A, a protruding T-block 96 may be provided at one end of each side wall 82 and 84. The outer surface 98 of the T-block 96 covers the space 100 between the side wall 82 or 84 of a removable segment 12 or 14, and the side wall 86 or 88 of an end segment 16 or 18.

One leaf 68 is provided with two support blocks 72 and 74 extending downwardly from its bottom surface 75. The support blocks 72 and 74 have through-bores for rotatably receiving a rod 76 that extends between the crossing bars 24 and 26. The opposing ends of the rod 76 are connected to blocks 78 and 80 extending upwardly from the crossing bars 24 and 26, respectively. The blocks 78 and 80 are also offset from the center of the crossing bars 24 and 26, but closer to the second extendable bar structure 30. Alternatively, the opposing ends of the rod 76 may be connected directly to the crossing bars 24 and 26, again at a position offset from the center of the crossing bars 24 and 26 and closer to the second extendable bar structure 30. Those skilled in the art will appreciate that although two blocks 72 and 74 are provided on each leaf 68, this is a non-limiting example, and that one block or more than two blocks may be provided on the bottom surface 75 of the leaf 68 for rotatably receiving the rod 76.

Thus, the rod 76 extends from one crossing bar 24, passes through the through-bores of the support blocks 72, 74 of removable segment 12, passes through the through-bores of the support blocks 72, 74 of removable segment 14, and terminates at the other crossing bar 26. The leaves 68 of the removable segments 12 and 14 can therefore pivot or rotate about the rod 76 to facilitate storage in the manner described hereinbelow.

The operation of the table 10 will now be described with reference to FIGS. 1–5. FIG. 1 illustrates the table 10 in a configuration where it is being used at its maximum size with the two removable segments 12 and 14 in place between the end segments 16 and 18. To reduce the overall size of the table top, one removable segment 14 is removed. To do so, the end segments 16 and 18 are pulled away from the removable segments 12 and 14, respectively, and the leaves 66 and 68 of the segment 14 folded about their hinge connections 70 to cause one leaf 66 to rest against the other leaf 68 (see FIGS. 2 and 3). The side walls 82 and 84 are folded inwardly towards the bottom surface 75 and held in place by the catch arrangement 94. The combined leaves 66, 68 are then rotated about the rod 76 so that the leaf 68 now rests on top of the leaf 66, and the bottom surface 75 of the leaf 66 rests on the support bar 58 (see FIG. 4). In this position, the combined leaves 66, 68 are positioned below the rod 76, with the bottom surface 75 of the leaf 68 facing upwardly (see FIG. 5). Therefore, the combined leaves 66, 68 are positioned below the top of the fixed bars 32, and with the side walls 82 and 84 folded and retained against the bottom surface 75, the leaves 66, 68 have a thin profile which allows them to be stored under the end segments 16 and 18. The rod 76 and the support bar 58 provide a stable support system for holding and storing the removable segment 14 under the table 10. The end segments 16 and 18 are now pushed back towards segment 12 to provide a smaller table top.

To reduce the size of the table top even further, the same steps set forth above may be repeated to fold and store the other removable segment 12 below the end segments 16 and 18. FIG. 4 illustrates both removable segments 12 and 14 in their folded and storage configurations before the end segments 16 and 18 are pushed back towards each other to create the smallest-sized table top allowed by the table 10. Those skilled in the art will appreciate that either removable segment 12 or 14 may be folded and stored first.

To re-install one or both of the removable segments 12 and 14, the end segments 16 and 18 are pulled away from each other, and the combined leaves 66, 68 of the removable segment 12 or 14 are rotated about the rod 76 so that the bottom surface 75 of leaf 68 rests on the fixed bar 32 of second extendable bar structure 30. The other leaf 66 is then unfolded about the hinge connections 70 and its bottom surface 75 rested on the fixed bar 32 of first extendable bar structure 28. The end segments 16 and 18 are then pushed towards the re-installed removable segment 12 or 14.

Thus, the table 10 according to the present invention provides a support system that enables two or more removable segments to be folded and stored under the table top. The support system includes a support bar 58 that supports one surface of a leaf 66, and a rod 76 that supports one surface of the other leaf 68. Both the support bar 58 and the rod 76 extend longitudinally across the table 10, thereby allowing a plurality of removable segments to be supported. The support system of the present invention provides a stable support for the removable segments when the removable segments 12, 14 are stored, and the table 10 according to the present invention makes it easy for the user to increase or decrease the size of the table top.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A table comprising:

first and second extendable bar structures positioned generally parallel to and spaced-apart from each other, each extendable bar structure having opposing first and second outer ends;

a first table end segment secured to the first outer ends of the first and second extendable bar structures;

a second table end segment secured to the second outer ends of the first and second extendable bar structures;

first and second crossing bars connected to and extending between the first and second extendable bar structures;

a rod connected between the first and second crossing bars; and a plurality of removable table segments positioned between the first and second table end segments, each removable table segment rotatably coupled to the rod to facilitate storage of each removable table segment under the first and second table end segments.

2. The table of claim 1, further comprising a support bar connected between the first and second crossing bars and spaced apart from the rod.

3. The table of claim 2, wherein each removable table segment comprises first and second leaves hingedly connected to each other, the first leaf having a bottom surface, and with the rod rotatably coupled to the bottom surface of the first leaf.

4. The table of claim 3, wherein the second leaf has a bottom surface which rests on the support bar, and the first leaf rests on the second leaf and is rotatably supported under the rod, when the removable table segment is stored under the table end segments.

5. The table of claim 3, wherein the first leaf comprises a block attached to the bottom surface thereof, the block comprising a through-bore for rotatably receiving the rod.

6. The table of claim 3, wherein each extendable bar structure comprises a fixed bar having opposing sides, and first and second slidable bars that are slidably coupled to each of the opposing sides of the fixed bar to facilitate relative movement between each slidable bar and the fixed bar.

7. The table of claim 1, wherein each extendable bar structure further comprises a ratchet wheel, and each slidable bar includes engaging teeth for communicating with the ratchet wheel.

8. The table of claim 6, wherein the first table end segment is secured to the first slidable bars of the first and second extendable bar structures, and the second table end segment is secured to the second slidable bars of the first and second extendable bar structures.

9. The table of claim 8, wherein the first and second crossing bars are connected to and extend between the fixed bars of the first and second extendable bar structures.

10. The table of claim 3, wherein the first leaf has a side wall, and the bottom surface of the first leaf has a catch arrangement, and wherein the side wall is folded towards the bottom surface of the first leaf and retained against the bottom surface by the catch arrangement when the removable table segment is stored under the first and second table end segments.

11. A table comprising:

a first table end segment and a second table end segment;

means for supporting the first and second table end segments;

first and second crossing bars coupled to the supporting means;

a rod connected between the first and second crossing bars;

a plurality of removable table segments positioned between the first and second table end segments;

means for rotatably coupling each removable table segment to the rod; and means for holding each removable table segment to facilitate storage of each removable table segment under the first and second table end segments.

12. The table of claim 11, wherein each removable table segment comprises first and second leaves hingedly connected to each other, the first leaf having a bottom surface, and with the rotatably coupling means coupling the rod to the bottom surface of the first leaf.

13. The table of claim 12, wherein the second leaf has a bottom surface which is supported by the holding means, and the first leaf rests on the second leaf and is rotatably supported under the rod, when each removable table segment is stored under the table end segments.

14. The table of claim 11, wherein the supporting means comprises a fixed bar having opposing sides, and first and second slidable bars that are slidably coupled to each of the opposing sides of the fixed bar to facilitate relative movement between each slidable bar and the fixed bar.

15. The table of claim 14, wherein the supporting means further comprises a ratchet wheel, and each slidable bar includes engaging teeth for communicating with the ratchet wheel.

16. The table of claim 14, wherein the first table end segment is secured to the first slidable bars, and the second table end segment is secured to the second slidable bars.

17. The table of claim 16, wherein the first and second crossing bars are connected to and extend between the fixed bars.

18. A table comprising:

first and second extendable bar structures positioned parallel to each other, each extendable bar structure comprising a fixed bar having opposing sides, and first and second slidable bars that are slidably coupled to each of the opposing sides of the fixed bar to facilitate relative movement between each slidable bar and the fixed bar;

a first table end segment secured to the first slidable bars;

a second table end segment secured to the second slidable bars;

first and second crossing bars connected to and extending between the fixed bars;

a rod connected between the first and second crossing bars;

a support bar connected between the first and second crossing bars and spaced apart from the rod; and a plurality of removable table segments positioned between the first and second table end segments, each removable table segment comprising first and second leaves hingedly connected to each other, the first leaf having a bottom surface rotatably coupled to the rod, and the second leaf having a bottom surface;

wherein the second leaf rests on the support bar, and the first leaf rests on the second leaf and is rotatably supported under the rod, when each removable table segment is stored under the table end segments.

19. The table of claim 18, wherein the first leaf comprises a block attached to the bottom surface thereof, the block comprising a through-bore for rotatably receiving the rod.

20. The table of claim 18, crossing ba first and second crossing bars are connected to and extend between the fixed bars.

* * * * *